US006326922B1

(12) United States Patent
Hegendoerfer

(10) Patent No.: US 6,326,922 B1
(45) Date of Patent: Dec. 4, 2001

(54) YAGI ANTENNA COUPLED WITH A LOW NOISE AMPLIFIER ON THE SAME PRINTED CIRCUIT BOARD

(75) Inventor: Max Heinrich Hegendoerfer, Forchheim/Ofr. (DE)

(73) Assignee: WorldSpace Corporation, Washington, DC (US)

( * ) Notice: Subject to any disclaimer, the term of this patent is extended or adjusted under 35 U.S.C. 154(b) by 0 days.

(21) Appl. No.: 09/605,396

(22) Filed: Jun. 29, 2000

(51) Int. Cl.[7] ..... H01Q 1/38; H01Q 9/26

(52) U.S. Cl. ..... 343/700 MS; 343/803; 343/815; 343/818

(58) Field of Search ..... 343/700 MS, 815, 343/818, 795, 803

(56) References Cited

U.S. PATENT DOCUMENTS

| | | | | |
|---|---|---|---|---|
| 3,707,681 | * | 12/1972 | Grant | 343/795 |
| 3,710,337 | * | 1/1973 | Grant | 343/815 |
| 4,518,968 | | 5/1985 | Hately | 343/802 |
| 4,701,764 | | 10/1987 | Malcombe | 343/742 |
| 4,853,702 | | 8/1989 | Shiokawa et al. | 342/363 |
| 5,008,681 | | 4/1991 | Cavallaro et al. | 343/700 |
| 5,272,485 | | 12/1993 | Mason et al. | 343/700 |
| 5,307,075 | | 4/1994 | Huynh | 343/700 |
| 5,396,202 | | 3/1995 | Scheck | 333/230 |
| 5,612,706 | | 3/1997 | Podell | 343/818 |
| 5,898,410 | | 4/1999 | DeMarre | 343/792.5 |
| 5,982,326 | * | 11/1999 | Chow et al. | 343/700 MS |
| 6,028,567 | * | 2/2000 | Lahti | 343/700 MS |

OTHER PUBLICATIONS

Kraus, John D., *Antennas*, 2nd Ed., p. 244, 708–710 (McGraw Hill, Inc. ©1988).

* cited by examiner

*Primary Examiner*—Don Wong
*Assistant Examiner*—Hoang Nguyen
(74) *Attorney, Agent, or Firm*—Roylance, Abrams, Berdo & Goodman, L.L.P.

(57) ABSTRACT

A Yagi antenna system consisting of a low noise amplifier (LNA) and a reflector co-located on the same printed circuit board (PCB) as the radiators and directors is disclosed. Furthermore, the balun cable is replaced by surface mount devices whose feed line is implemented in microstrip technology, all co-located on the same printed circuit board.

16 Claims, 5 Drawing Sheets

YAGI ANTENNA COUPLED WITH A LOW NOISE AMPLIFIER ON THE SAME PRINTED CIRCUIT BOARD

FIELD OF THE INVENTION

The present invention relates to a Yagi antenna system wherein the active and parasitic elements of the antenna can be co-located on one printed circuit board (PCB) with a low noise amplifier (LNA). Furthermore, surface mount devices (SMDs) can replace the balun that is conventionally used for impedance matching between the symmetrical radiator impedance and the asymmetrical LNA input impedance.

BACKGROUND OF THE INVENTION

Yagi antennas are used in high frequency applications such as satellite radio transmission. There presently exists a population of 4 billion people that are generally dissatisfied and underserved by the poor sound quality of short-wave or terrestrial radio broadcast systems. This population is primarily located in Africa, Central and South America, and Asia. FIG. 1 shows an overview of a satellite broadcast system 10 comprising various broadcast stations 2 for transmitting multiple audio signals, for example, to a satellite 4, which in turn transmits these signals to the receivers 9. The satellite broadcast system 10 is particularly useful for providing high-quality broadcast programming to users in Africa, Central and South America, and Asia. The present invention relates to a low-cost antenna that can be mounted on a portable radio receiver 9 for reception of satellite radio transmissions. This invention is particularly useful for the reception of satellite signals where a receiver antenna gain on the order of 9 dbi together with a noise figure on the order of 1 dB are required due to the low power flux density available at the receiver location.

Yagi antennas generally consist of three types of elements: reflector, radiator, and directors. The radiator (e.g., a folded dipole) is an active element that receives the power concentrated by the parasitic elements. The reflector is a parasitic element with an inductive quality. The directors are also parasitic elements but with a capacitive quality. Yagi antenna systems use the parasitic elements in combination with active elements to control the direction and width of the beam. The Yagi antenna optimizes gain by using specific director lengths and spacing between the directors and the driven element (e.g., the radiator).

In addition, the Yagi antenna typically employs a balun (e.g., a half wavelength coaxial line) to achieve a 180 degree phase shift of the signal. Specifically, as seen in FIG. 2, a coaxial cable 32 is physically connected to the driven element (e.g., folded dipole) 40. The inner sheath 38 is connected to one side of the folded dipole 40 and the feed cable 34, and the opposite inner sheath 39 is connected to the opposite side of the dipole. The outer sheath 36 is connected to ground. As the signal travels around the inner sheath from 39 to 38 it becomes 180 degrees phase shifted from the original signal. This cable and dipole arrangement is cumbersome and prevents an antenna arrangement from being constructed on a simple printed circuit board. A need exists for a more compact means to drive the components of a Yagi antenna.

A compactly designed Yagi antenna is disclosed in U.S. Pat. No. 5,612,706. However, this antenna merely reduces the distance between two rods and is not well suited for radio receiver portability. It is more convenient to have a Yagi antenna that can be folded for transportation. Further, it would be advantageous to have a less costly implementation than the one disclosed in U.S. Pat. No. 5,612,706.

Removal of the balun is described in U.S. Pat. No. 5,898,410. A log periodic dipole array antenna system achieves impedance matching by adjusting the distance between a focusing element and one of several dipoles or driven elements. The antenna system therefore has plural active elements and, correspondingly, impedance matching requirements for each of these elements. A need exists for a low-cost antenna having a simple active element impedance matching design.

A performance limitation of the Yagi antenna is the signal loss caused by cables and connectors between the antenna feed point and the low noise amplifier input stage. There is currently a requirement to match the antenna feed point to a standard impedance (such as 50 ohms) which can be accommodated by off-the-shelf connectors and cables, and then again match the impedance to the low noise amplifier input stage. This sequential impedance matching requirement incurs line and connector losses, which in turn detrimentally affect the performance of the Yagi antenna.

As shown in FIG. 3, some patch and Yagi antenna systems 10 use dual circular polarization outlets which can be costly due to the type and number of components. For example, the system shown requires two outlets, that is, a right-hand circular polarization outlet 18 and a left-hand circular polarization outlet 16, two low-noise amplifier (LNA) input stages 24 and 26, an electronic polarization switch 14, and at least two housing mounts 12 and 13.

Manufacturing costs are also a contributing factor to the expense of the receivers 9. It is known in the art to use coaxial cables 20 and 22 to connect the LNA input stages 24 and 26 to the antenna outlets 18 and 16 to achieve impedance matching. However, as mentioned in U.S. Pat. No. 4,518,968, balanced low impedance feeders have been recommended, but have not often been adopted in practice. This is because such feeders, when engineered for dipole and Yagi-Uda array matching impedances, are dimensionally awkward to manufacture and install. Further, since the folded dipole and the director elements are separate from the low noise amplifier (LNA), two fabrication procedures are needed, thereby increasing the likelihood of problems due to manufacturing tolerances. Thus, a need exists for a low cost Yagi antenna design that is easily mass-produced with a low error tolerance.

It is known, for example, from U.S. Pat. No. 5,272,485, to use antennas embedded in substrates in microwave frequency applications where a feedpoint and via are used as an input to a low noise amplifier, thereby obtaining optimum impedance matching. However, these diagonally-fed electric microstrip dipole antennas are patch antennas that are constructed on at least two layers of a dielectric substrate. These types of patch antennas cannot be designed for high gain without using an array of patches, thereby incurring a negative effect on complexity and size.

Accordingly, a need exists for a more simple means of impedance matching of a Yagi antenna with only one driven element. A need also exists for an active antenna system that is low cost and readily mass-produced while providing reasonably high gain, directivity and noise performance. A foldable design is desirable to keep the antenna compact for travel.

SUMMARY OF THE INVENTION

These needs and others are satisfied by the Yagi antenna system of the present invention which, in a preferred embodiment, comprises an LNA, reflector, radiator or driven element, and at least one director all located on the same printed circuit board. Therefore, the present invention can eliminate the need for two separate housings, that is, one containing the LNA and the other containing the radiator and the directors.

An object of the present invention is to provide a low cost antenna that allows for simple and cost-effective mass manufacturing. This is possible because the antenna system of the present invention can be located on one printed circuit board, thus allowing for tighter tolerances during mass production.

Another object of the present invention is to eliminate the need for a balun cable. Since all the elements of the antenna can be located on the same printed circuit board, signal losses caused by coaxial cables and connectors and by the impedance matching between the LNA and the driven element are minimized as well.

Yet another object of the present invention is to provide a simple means of achieving the 180 degree phase shifting requirement for the feed to the opposite dipole side. The present invention eliminates the need for a signal cable in front of the LNA because of the preferred single circuit board design. Further, to avoid the balun cable, the phase shifting can be accomplished by means of surface mount devices located on the same printed circuit board.

Still another object of the present invention is to allow for the ability to fold the antenna for transportation purposes. The present invention allows for the elimination of electrical connections, such as cables, required between the parasitic and active elements. Therefore, the antenna design can comprise two flexibly connected plates which can be folded together during transport The front plate can contain an array of directors printed on a printed circuit board. The directors can comprise metallic rods or stripes inserted into a front plate compartment in a preferred embodiment of the present invention.

BRIEF DESCRIPTION OF THE DRAWINGS

These and other objects, advantages and novel features of the present invention will be more readily appreciated from the following detailed description when read in conjunction with the accompanying drawings, in which.

DETAILED DESCRIPTION OF THE PREFERRED EMBODIMENTS

Figure 4:
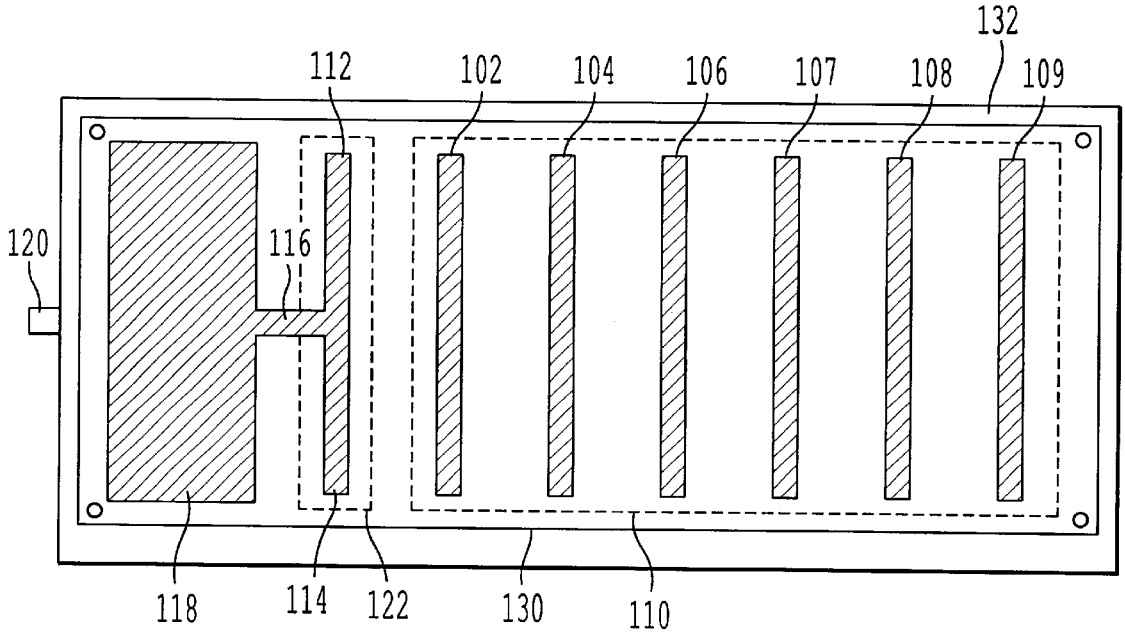
FIG. 4 is a schematic representation of a Yagi antenna receiver system in accordance with an embodiment of the present invention.

FIG. 4 illustrates an integrated Yagi antenna and low noise amplifier system 100 in accordance with a preferred embodiment of the present invention. The entire system 100 is preferably located on one epoxy glass fiber printed circuit board 130. The printed circuit board 130 can be manufactured with any suitable material and is not limited to epoxy glass fiber. The system 100 consists of an F-connector 120 which attaches to the antenna transmission line of the receiver such as the radio receiver 9. The Yagi antenna system 100 is comprised of a reflector combined with a low noise amplifier (LNA) indicated at 118 which are implemented using surface mount device technology. The reflector and LNA combination 118 are in turn connected to the radiator 122. The reflector and the LNA are co-located on the same printed circuit board. This design eliminates the cables and connectors used with conventional Yagi antennas which produce signal loss in front of the low noise amplifier 118 and reduce antenna sensitivity.

As described below in connection with FIG. 5, surface mount device (SMDs) are used to facilitate the connection between the symmetrical dipole feed points 112 and 114 of the radiator 122 and the LNA 118. The SMDs are indicated generally at 50 in FIG. 4. This allows for the two dipole feed points 112 and 114 to be driven approximately 180 degrees out of phase with respect to each other. As this method avoids the use of a balun cable, the complete antenna and LNA system 100 of FIG. 4 can now be implemented on one substrate 132 and can be enclosed in one housing 134 having a single mount for connection to a receiver such as the radio receivers 9. The SMDs can be mounted on the printed circuit board 130, specifically substrate 132, of FIG. 4 and encased using a plastic material, for example, to more easily accommodate folding of the antenna. The encasing material is not limited to plastic, but can be any material that is appropriate. Such a design is more compact than a conventional Yagi antenna having coaxial sheath and core connections to the respective dipole feed points 112 and 114. The preferred embodiment of the present invention employs a folded dipole as the driven element for ease with impedance matching, but an open dipole design could be used as well. Further, the type of driven element is not limited to an open or folded dipole design, and any appropriate design can be employed.

Figure 5:
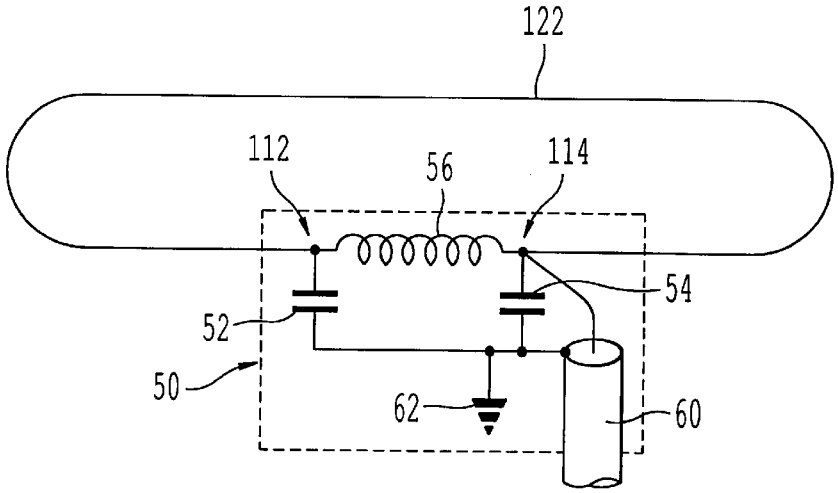
FIG. 5 is a schematic representation of the signal and phase shift feeding to the folded half wave dipole director element in accordance with an embodiment of the present invention.

FIG. 5 illustrates the SMDs 50 which are preferably two capacitors 52 and 54 and an inductor 56. The capacitors 52 and 54 each have one terminal connected to opposite terminals of the inductor 56 and the other terminal connected to ground 62 (e.g., the backplane of the substrate 132). The feed line 60, which is preferably implemented using microstrip technology on the substrate 132, is connected to the feed point 114.

The SMDs 50 allow for the signal on the feed line 60 directly connected to one of the dipole feed points 114 to be approximately 180 degrees out of phase with respect to the signal on the opposite feed point 112 of the folded dipole. The SMDs 50 are useful for antennas in a satellite broadcast system 100, since such systems preferably use a limited bandwidth of about 1432–1512 Mhz or in the S-band range of 2630–2655 Mhz. The same design can be utilized in applications with higher or lower bandwidths, but the number of SMDs is adjusted to correlate to the bandwidth.

Figure 1:
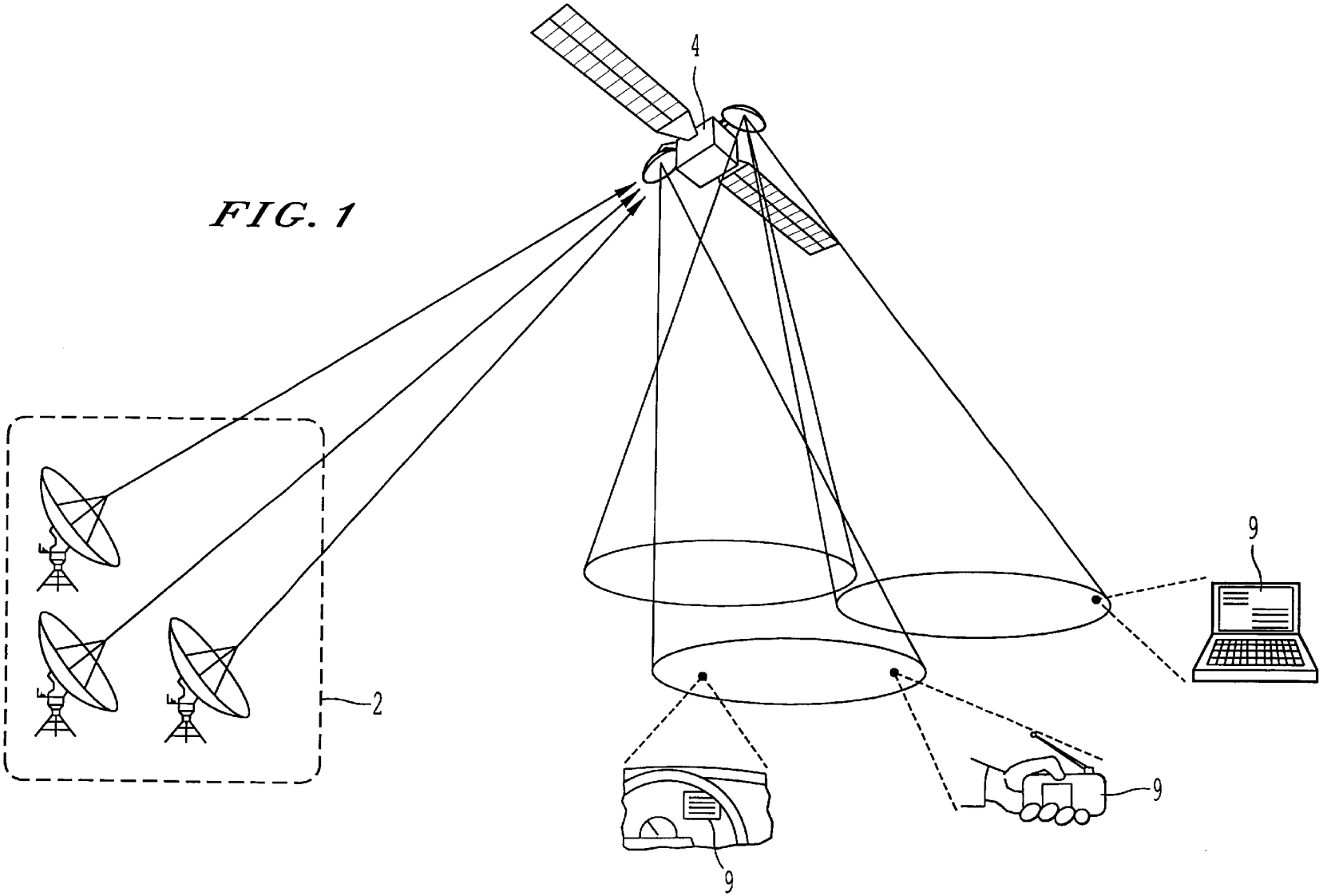
FIG. 1 is an overview of a satellite broadcast system.
Figure 2:
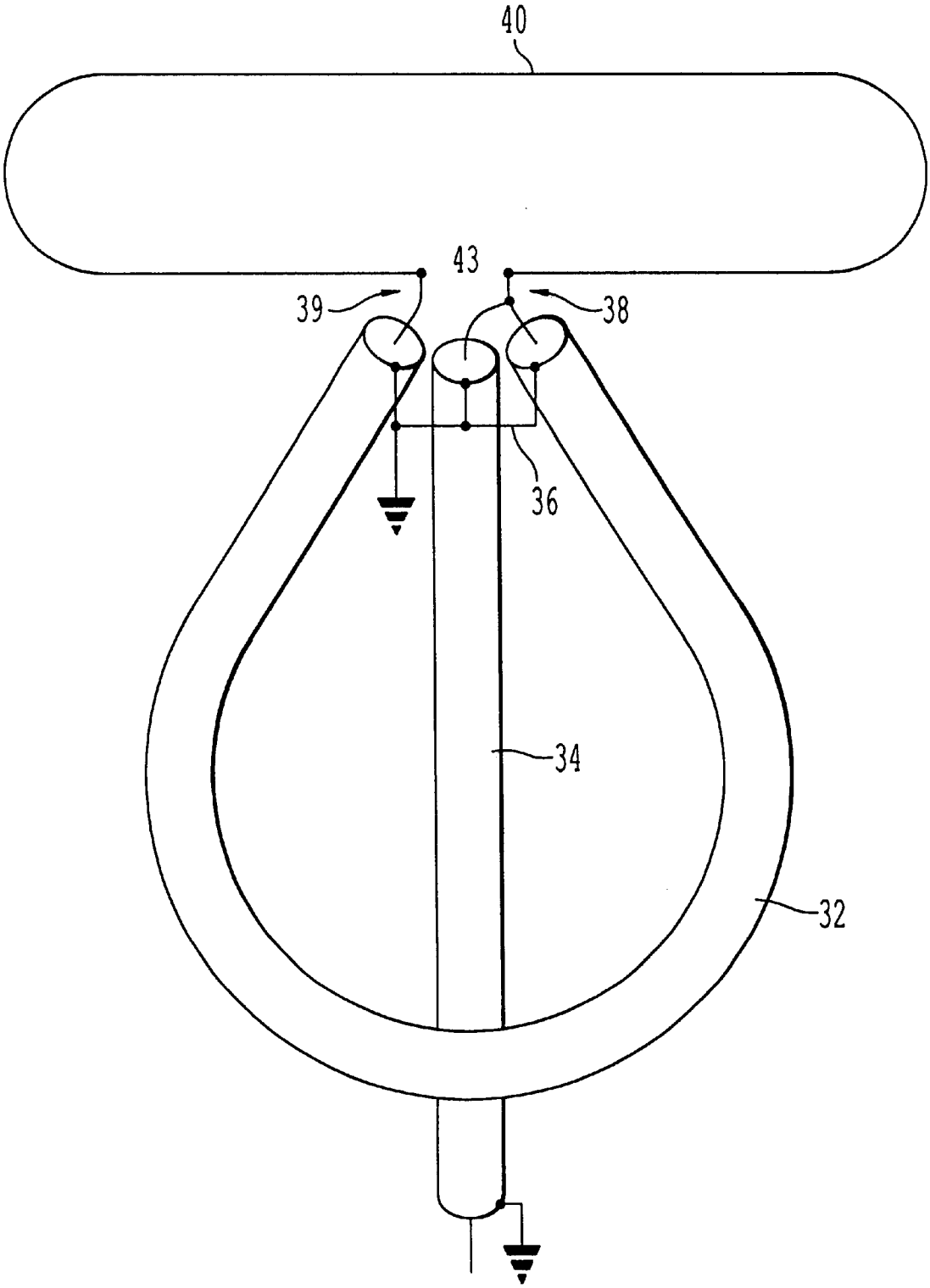
FIG. 2 (PRIOR ART)
FIG. 2 is schematic representation of a prior art coaxial cable connected to a half wave dipole director element.
Figure 3:
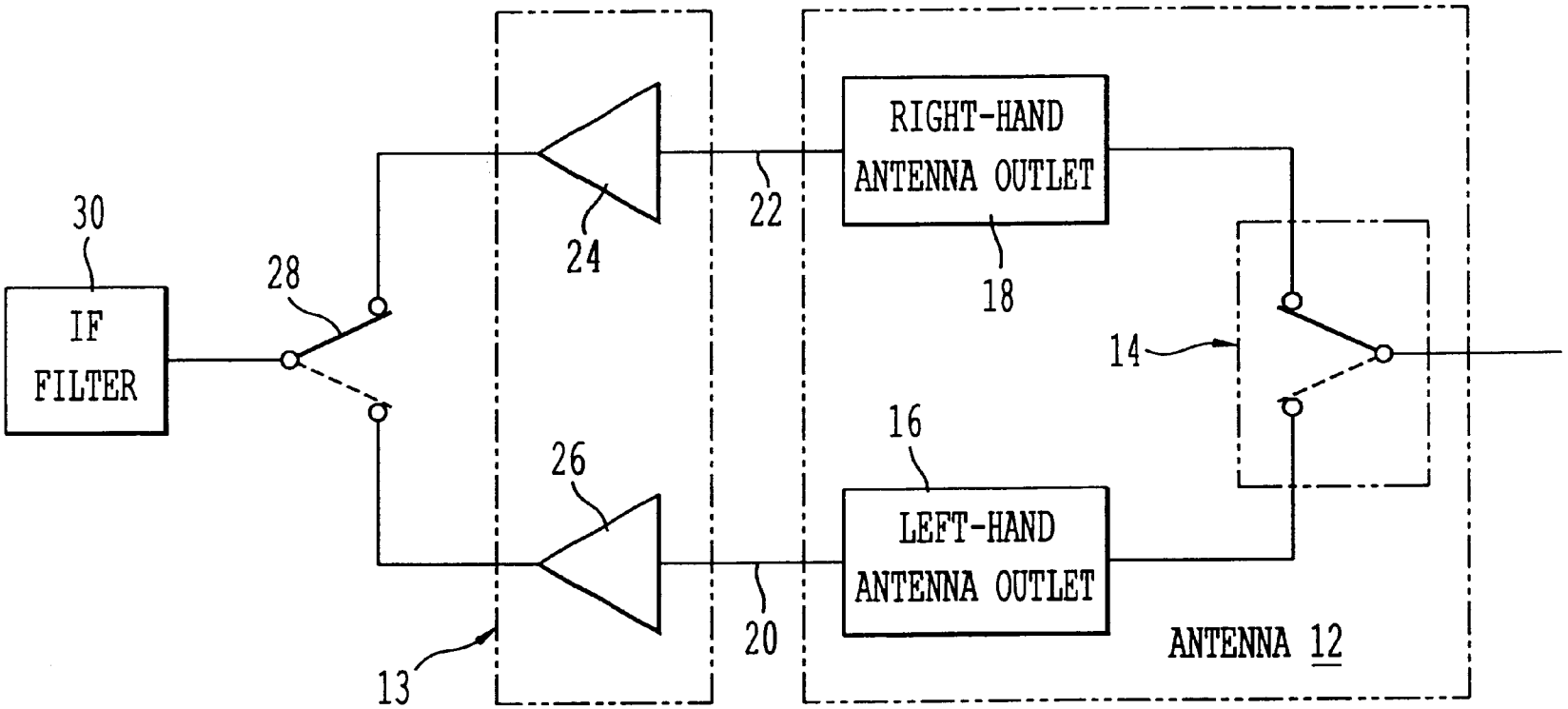
FIG. 3 (PRIOR ART)
FIG. 3 is a schematic representation of a prior art circularly polarized antenna system.

To further reduce the cost of the antenna and LNA system 100, antenna operation is preferably linear, as opposed to circular, polarization. FIG. 3 shows the circular polarization technique. As mentioned above, circular polarization employs costly and duplicate components to process the left-hand and right-hand polarized signals. In order to meet the need for a low cost receiver, many components are eliminated or at a minimum reduced in number in the present system 100 by employing a linear reception mode for the circularly polarized signals. Benefits of a linear technique are the need for only one low noise amplifier input stage, and the elimination of the polarization switch and control logic to switch between the right-hand and left-hand polarized signal channels. In addition, one linear antenna can feed multiple receivers. The preferred embodiment of the present invention is able to employ this linear signal processing mode for left-hand and right-hand circularly polarized signals because the satellite broadcast system 100 does not require cross-polar separation. In addition to the difference in the polarization mode, the individual signals are displaced in frequency, thereby permitting the receiver tuning and selectivity to opt for either the right-hand or left-hand signal.

Since only one component of the circular radiation field is used, there is a signal loss of 3 db. This loss is compensated for by increasing the gain of the antenna by adding parasitic elements, thus enlarging the size of the antenna This is less expensive than using, alternatively, the configuration of FIG. 3. Addition of these parasitic elements or directors is easily accommodated by the foldable design. The metallic axis within the fold of the antenna can be used as one of the magnetically coupled directors. This design allows for more room on the substrate 32 for placement of additional directors if needed.

Figure 6:
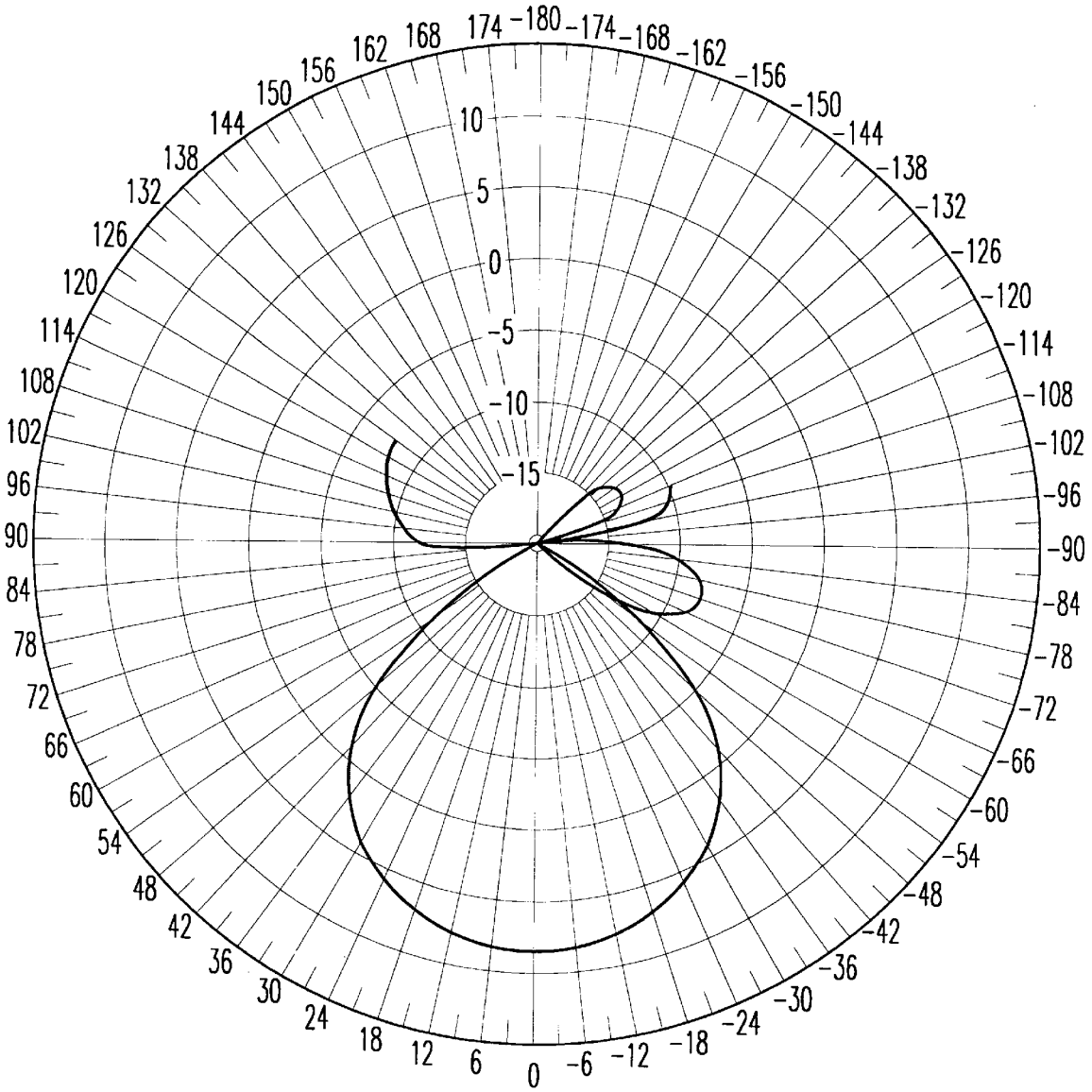
FIG. 6 is a polar graph illustrating the antenna beam pattern of the Yagi antenna constructed in accordance with an embodiment of the present invention.

As an additional benefit, this higher directivity offers better protection against interference, especially in the case of a linear interfering signal where the antenna can be decoupled by orienting it accordingly. Furthermore, users generally do not experience difficulties with antenna pointing, as the antenna lobe is still rather wide as shown in FIG. 6. The 3 dB gain reduces the lobe width typically to 70%.

FIG. 6 shows the polar rotational diagram of a beam pattern for the antenna and LNA system 100. The beam pattern demonstrates the ability of the antenna to deliver quality signals despite sub-optimum orientation by the user and further how much gain the antenna delivers if the antenna is turned slightly. For example, at optimum pointing, or 0 degrees, the antenna achieves a 9 db gain This does not drop off to 8 db until approximately 15 degrees away from optimum pointing. Furthermore, the antenna gain reaches 0 db at approximately 40 degrees. This figure shows the antennas tolerant gain despite the users error during antenna orientation.

The antenna system described herein offers many advantages since all of the components of the antenna and LNA system 100 can be placed on one printed circuit board. There is no need for bulky cables or connectors or for impedance matching. This allows for a simple design that facilitates portability of the radio receiver. Since the antenna can be placed on one printed circuit board, the present invention realizes reduced cost, and reduced likelihood for manufacturing tolerances and faults, allowing for the capability of excellent mass production. The preferred embodiment of the present invention employs linear signal processing as opposed to circular polarization processing to further reduce cost due to a reduction in the number of components in the system.

Although the present invention has been described with reference to a preferred embodiment thereof, it will be understood that the invention is not limited to the details thereof. Various modifications and substitutions will occur to those of ordinary skill in the art. All such substitutions are intended to be embraced within the scope of the invention as defined in the appended claims.

What is claimed is:

1. An antenna system having an output connected to an antenna transmission line and the input for receiving signals from a satellite communications network, said antenna system comprising:

a low noise amplifier connected to said output; and active and parasitic antenna elements comprising at least one reflector and a radiator, and a single printed circuit board with said active and parasitic antenna elements and said low noise amplifier directly located thereon.

2. The antenna system as claimed in claim 1, wherein said antenna system operates in the frequency range of 2630 to 2655 Mhz.

3. The antenna system as claimed in claim 1, wherein said antenna system operates in the frequency range of 1432 to 1512 Mhz.

4. An antenna system as claimed in claim 1, wherein said radiator is a dipole radiator configured to receive signals from said reflector on one pole thereof, said printed circuit board comprising surface mount devices to phase shift said signal to feed the other pole of said dipole radiator.

5. An antenna system as claimed in claim 4, wherein said radiator is a folded dipole.

6. An antenna system as claimed in claim 4, wherein said radiator is an open dipole.

7. An antenna system within a satellite communications network, said antenna system being embedded on a flat substrate with opposite first and second sides, wherein said first side is configured to have an F-connector to couple said antenna system to an antenna transmission line, said antenna system having at least one low noise amplifier and reflector assembly proximate to said F-connector, and at least one radiator proximate to said low noise amplifier and reflector assembly, said at least one radiator configured to deliver a signal to said at least one low noise amplifier assembly, said antenna system having at least one director located on said second side and distal from said F-connector to receive said signal from said satellite communications network.

8. A method for receiving signals via an antenna system from a satellite communications network comprising the steps of:

receiving said signals through at least one director;

coupling part of said signal to a radiator, the remaining part of said signal being reflected to said radiator by a reflector; and delivering said coupled signal to a low noise amplifier which is co-located with said radiator and said reflector and directly disposed on a single printed circuit board to deliver said signal to an antenna transmission line.

9. An antenna system as claimed in claim 8, wherein said antenna system comprises two foldable plates with one plate comprising a low noise amplifier assembly, reflector, and radiator, and the other plate comprising at least one director that is electromagnetically coupled with said radiator and said reflector.

10. An antenna system as claimed in claim 9, further comprising another director comprising a metallic axis along which to fold said two foldable plates.

11. An antenna system as claimed in claim 8, wherein said antenna system comprises two foldable plates constructed from a plastic material.

12. An antenna system having an output connected to an antenna transmission line and the input for receiving signals from a satellite communications network, said antenna system comprising:

a low noise amplifier connected to said output; and active and parasitic antenna elements comprising at least one reflector and a radiator, wherein said radiator is a dipole radiator configured to receive signals from said reflector on one pole thereof; and a printed circuit board with said active and parasitic antenna elements and said low noise amplifier located thereon, said printed circuit board comprising surface mount devices to phase shift said signal to feed the other pole of said dipole radiator.

13. An antenna system as claimed in claim 12, wherein said radiator is a folded dipole.

14. An antenna system as claimed in claim 12, wherein said radiator is an open dipole.

15. A method for receiving signals via an antenna system from a satellite communications network, said method comprising the steps of:

receiving said signals through at least one director;

coupling part of said signal to a radiator, the remaining part of said signal being reflected to said radiator by a reflector;

delivering said coupled signal to a low noise amplifier which is co-located with said radiator and said reflector on a printed circuit board to deliver said signal to an antenna transmission line; and wherein said antenna system comprises two foldable plates with one plate comprising a low noise amplifier assembly, reflector, and radiator, and the other plate comprising at least one director that is electromagnetically coupled with said radiator and said reflector.

16. An antenna system as claimed in claim 15, further comprising another director comprising a metallic axis along which to fold said two foldable plates.

* * * * *